United States Patent [19]

Kiracofe et al.

[11] Patent Number: 4,932,593

[45] Date of Patent: Jun. 12, 1990

[54] FUEL INJECTOR

[75] Inventors: John W. Kiracofe, Simpsonville; Randy C. Baxter, Taylors, both of S.C.

[73] Assignee: Lucas Industries Public Limited Company, Birmingham, England

[21] Appl. No.: 224,761

[22] Filed: Jul. 27, 1988

[30] Foreign Application Priority Data

Aug. 7, 1987 [GB] United Kingdom ..... 8718732

[51] Int. Cl.[5] ..... B05B 1/26

[52] U.S. Cl. ..... 239/585; 239/104; 239/125; 222/571

[58] Field of Search ..... 239/585, 124, 125, 428.5, 239/104, 533.2, 533.9, 533.15; 222/571; 137/808, 811

[56] References Cited

U.S. PATENT DOCUMENTS

| | | | |
|---|---|---|---|
| 2,989,249 | 6/1961 | Richter | 239/428.5 |
| 3,130,915 | 4/1964 | Aghnides | 239/428.5 |
| 3,685,742 | 8/1972 | Jackson | 239/428.5 |
| 3,827,636 | 8/1974 | Parkison et al. | 239/428.5 |
| 4,322,292 | 3/1982 | Knox | 239/428.5 |
| 4,548,361 | 10/1985 | Paschke | 239/106 |
| 4,637,554 | 1/1987 | Takeda | 239/585 |
| 4,646,974 | 3/1987 | Sofianek et al. | 239/585 |
| 4,813,610 | 3/1989 | Renowden | 239/518 |

FOREIGN PATENT DOCUMENTS

| | | |
|---|---|---|
| 563174 | 11/1923 | France . |
| 2051385 | 5/1986 | France . |
| 6185568 | 4/1971 | Japan . |
| 2058914 | 4/1981 | United Kingdom . |
| 2155693 | 9/1985 | United Kingdom . |

*Primary Examiner*—Andres Kashnikow
*Assistant Examiner*—Christopher G. Trainor
*Attorney, Agent, or Firm*—Fleit, Jacobson, Cohn, Price, Holman & Stern

[57] ABSTRACT

A fuel injector for supplying liquid fuel to an air inlet manifold of a spark ignition engine has a fuel-inlet, an outlet defined in a tubular component mounted in a tubular part of the injector body, and at least one orifice formed in a valve seat member downstream of a valve member. The tubular component is spaced downstream from the valve seat member. An air circulation duct is defined between the tubular component and tubular part, so that spray of fuel flowing through the outlet draws air through the duct to minimize dribble of fuel from the injector.

20 Claims, 1 Drawing Sheet

FUEL INJECTOR

BACKGROUND OF THE INVENTION

This invention relates to a fuel injector for supplying liquid fuel to an air inlet duct of a spark ignition engine, the injector comprising a valve seat member defining an annular seating for engagement by a solenoid actuated valve member, an orifice through which fuel under pressure can flow when the valve member is lifted from the seating and a tubular outlet through which in use fuel flows from the orifice to the air inlet duct.

Such injectors are well known in the art and may be provided with more than one orifice. The fuel flowing through the orifice forms a fuel spray which exits from the outlet to mix with the air flowing in the air inlet duct. In the case where the seat member has more than one orifice the jets of fuel leaving the orifices may impinge on each other to provide a special spray pattern. Care is taken to ensure that the fuel spray leaving the orifice or orifices does not impinge on the side wall of the outlet unless a special spray pattern is required. However, since a precise spray pattern is not produced some droplets of fuel do impinge on the wall of the outlet and the tendency is for the droplets of fuel to coalesce to form a larger drop which eventually fails into the air inlet duct. The tendency for this to happen increases as the inclination of the longitudinal axis of the nozzle from the vertical increases. The large drops of fuel do not mix properly with the air flowing to the engine cylinders and simply wet the surface of the air inlet duct thereby causing combustion problems.

Moreover, in injectors in which the diameter of the outlet is small, fuel can accumulate within the outlet thereby impairing and in some cases inhibiting the formation of a fuel spray.

BRIEF SUMMARY OF THE INVENTION

The object of the present invention is to provide an injector of the kind specified in a simple and convenient form.

According to the invention in an injector of the kind specified an air circulation duct is provided which opens into the outlet at a position adjacent the valve seat member, to allow air to be drawn into the outlet by the action of the fuel spray.

According to a further feature of the invention the outlet is defined by a tubular component which is located in a tubular part of the housing of the injector, the inner end of the tubular component being spaced from the valve seat member, and an air circulation duct defined between the component and the interior of the tubular part of the body, the duct extending to adjacent the outer end of the component.

BRIEF DESCRIPTION OF THE DRAWINGS

An example of a fuel injector in accordance with the invention will now be described with reference to the accompanying drawings wherein.

DETAILED DESCRIPTION OF THE INVENTION

Figure 1:
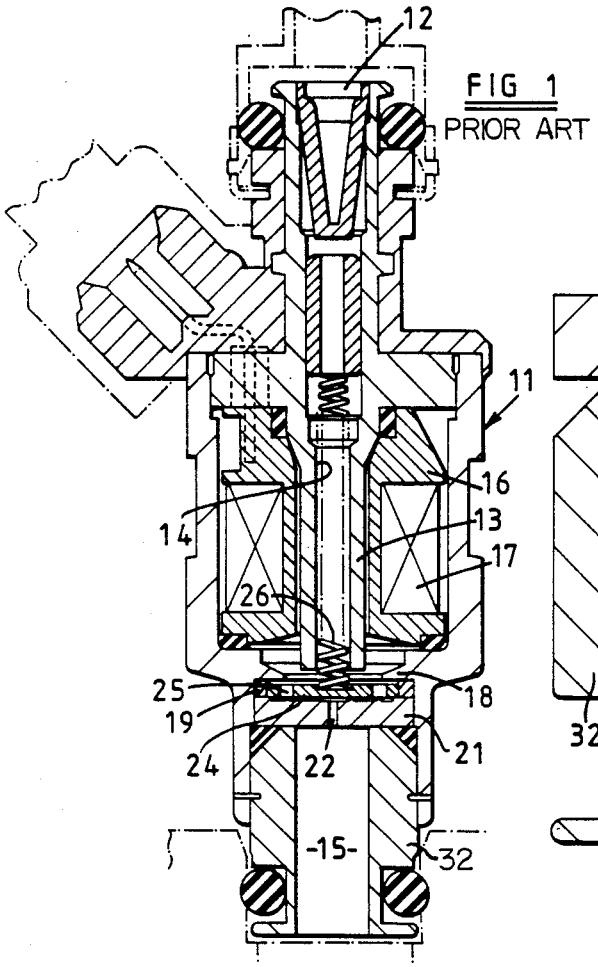
FIG 1 PRIOR ART
FIG. 1 is a longitudinal cross-sectional view of a known form of injectors.

Referring to FIG. 1 of the drawings the injector comprises a hollow generally cylindrical outer body 11 formed from magnetic material and within the body there extends a magnetic hollow flanged core 13. Extending within the core is a passage 14 which connects an inlet 12 with an outlet 15 of the body. Surrounding the core 13 is a former 16 which is formed from synthetic resin material and upon which is wound a solenoid winding 17. The outlet, which in the example of FIG. 1 is in the form of a sleeve retained within the body 11, projects in use into the air inlet duct of a spark ignition engine.

Adjacent the outlet 15 the body 11 defines an integral radially inwardly extending annular shoulder 18 against which a non-magnetic annulus 19 is trapped by a non-magnetic valve seat member 21. The valve seat member is in the form of a disc the diameter of which is equal to the internal diameter of the body 11 and the disc has a central outlet orifice 22 formed therein. The orifice extends from the surface of the valve seat member remote from the outlet and it is surrounded by a pair of annular spaced valve seat elements which project above the general level of the aforesaid surface.

Located within the non-magnetic annulus 19 is a valve member 24 which is formed from magnetic material. The valve member is in the form of a disc slidably received within the annulus 19. Formed in the valve member is a plurality of circumferentially spaced apertures 25 which are disposed outside the innermost valve seat element. The valve member is biased into contact with the valve seat elements by means of a coiled compression spring 26 which is housed within the passage 14.

The shoulder 18 and the end face of the core 13 form the pole pieces of a solenoid which includes the winding 17 and when the winding is energized the pole pieces assume opposite magnetic polarity. The internal diameter of the shoulder 18 is less than the diameter of the annulus 19 and the shoulder therefore overlies the outer peripheral portion of the valve member. Upon energizing the winding the valve member is attracted towards the shoulder and the end of the core to allow fuel flow through the orifice 22. When the solenoid winding is de-energized the spring 26 returns the valve member into contact with the seating elements to interrupt the flow of fuel through the orifice 22.

Figure 2:
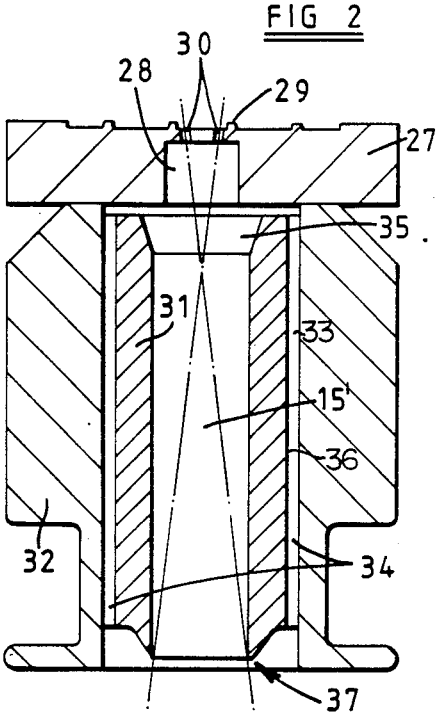
FIG. 2 is a cross-sectional view on an enlarged scale of part of the injector shown in FIG. 1 and modified in accordance with the invention.
Figure 3:
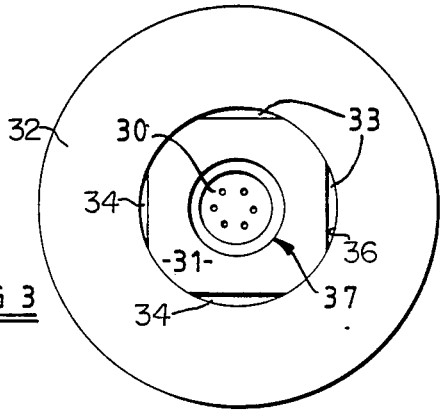
FIG. 3 is a bottom plan view of the portion of the injector shown in FIG. 2.

Referring now to FIG. 2 the valve seat member 27 is formed with a central cylindrical recess 28 in its face remote from the valve member and opening into the recess from within the inner seat element 29, are six orifices 30 which are angularly spaced, as shown in FIG. 3, about the axis of the nozzle. Moreover, as will be seen from FIG. 2, the axes of the orifices are inclined. In addition, the outlet 15 is defined by a tubular component or member 31 which is secured within a bore 36 in tubular part 32 of the body. The tubular component 31 is spaced from the seat member 27 and furthermore, as shown in FIG. 3, is provided with four equiangularly spaced flats 33 which define together with bore 36 air circulation ducts 34 extending between the ends of the tubular component. The inner end of the tubular component adjacent valve seat member 27 is provided with an internal flared entrance portion 35 and at the component outer end of the tubular component the material forming the outer surface of the component is machined away , or chamfered, to form an annular sharp edge 37. Moreover, the angle of the orifice 30 and the length of the component 31 are so chosen that the spray pattern produced by the jets of fuel flowing through the orifices 30 in the main just clears the outer end of the tubular component.

As previously explained the spray produced by the orifices does not have a precise pattern and droplets of the spray will impinge upon the inner surface of the component and will coalesce to produce larger drops of fuel. However, the spray which is formed in the bore in the tubular component 31 will entrain air and will therefore cause an air flow through the ducts 34 in the direction opposite to the flow of fuel. Any drops of fuel which do tend to form at or near the sharp edge 37 will be entrained in the air flowing towards the ducts 34 and will therefore tend to be drawn upwardly through the ducts and returned to the inner end of the bore within the tubular component. As a result there will be a reduced tendency for large drops of fuel to fall into the air inlet duct of the engine. Moreover, since air can flow along the ducts the risk of excess liquid fuel collecting within the bore in the tubular component and thereby impairing or inhibiting the formation of a fuel spray, is minimized.

As a result of the air flow through the bore in the tubular component, it is anticipated that the atomization of the fuel will be improved. Moreover, tests have shown that a satisfactory spray pattern can be obtained even when the longitudinal axis of the nozzle is substantially horizontal.

Although in the example the ducts are defined by flats formed on the tubular member, they can be defined between ribs angularly spaced about the tubular member, and which support the tubular member within the part 32. The ribs may be defined on the tubular member within the bore in the part.

Moreover, the bore 15' in the tubular member 31, particularly when a single orifice is formed in the orifice plate, may taper inwardly almost to the outer end of the tubular member.

We claim:

1. A fuel injector for supplying liquid fuel to an air inlet duct of a spark ignition engine comprising:

an injector body;

a valve seat member in said injector body;

at least one annular valve seat on said valve seat member;

a solenoid actuated valve member engageable with said at least one annular valve seat in a closed position and disengageable from said at least one annular valve seat in an open position;

at least one orifice in said valve seat member through which fuel flows in said open position;

a tubular outlet member defining an outlet passage for the fuel;

an entrance portion for said outlet passage in said tubular outlet member adjacent said valve seat member for receiving fuel from said at least one orifice into said outlet passage when said valve member is in said open position, the fuel from said at least one orifice forming a fuel spray flowing through said outlet passage;

an exit end for said outlet passage on said tubular outlet member;

a chamfered portion on said tubular outlet member defining a sharp edge at said exit end of said outlet passage; and air circulation duct means extending from a position adjacent said exit end to a position adjacent said valve seat member for flow of air into said outlet passage through said entrance portion caused by said flow of fuel spray through said outlet passage.

2. A fuel injector as claimed in claim 1 wherein:

an outlet bore is provided in said injector body;

said tubular outlet member is disposed in said outlet bore;

said tubular outlet member at said entrance portion is spaced from said valve seat member; and said air circulation duct means is disposed between said tubular outlet member and said outlet bore and includes the space between said tubular outlet member and said valve seat member.

3. A fuel injector as claimed in claim 1 wherein:

at least one flat surface is provided on the outer surface of said tubular outlet member and defines part of said air circulation duct means.

4. A fuel injector as claimed in claim 2 wherein:

at least one flat surface is provided on the outer surface of said tubular outlet member and defines part of said air circulation duct means.

5. A fuel injector as claimed in claim 3 wherein:

said tubular outlet member has a cylindrical form.

6. A fuel injector as claimed in claim 4 wherein:

said tubular outlet member has a cylindrical form.

7. A fuel injector as claimed in claim 3 wherein:

said at least one flat surface comprises a plurality of circumferentially spaced flat surfaces.

8. A fuel injector as claimed in claim 6 wherein:

said at least one flat surface comprises a plurality of circumferentially spaced flat surfaces.

9. A fuel injector as claimed in claim 4 wherein:

said at least one flat surface comprises a plurality of circumferentially spaced flat surfaces.

10. A fuel injector as claimed in claim 5 wherein:

said at least one flat surface comprises a plurality of circumferentially spaced flat surfaces.

11. A fuel injector as claimed in claim 1 wherein:

said tubular outlet member has a cylindrical form.

12. A fuel injector as claimed in claim 1 wherein:

said entrance portion for said outlet passage is flared outwardly in the direction of said valve seat member.

13. A fuel injector as claimed in claim 1 and further comprising:

a recess in said valve seat member having an open end adjacent said tubular outlet member and a base; and wherein said at least one orifice comprises a plurality of orifices through said base.

14. A fuel injector as claimed in claim 13 wherein:

said orifices are directed at an angle with respect to each other and with respect to said outlet passage so that in use a substantially conical fuel spray issues from said exit end of said outlet passage.

15. A fuel injector as claimed in claim 11 wherein:

said entrance portion for said outlet passage is flared outwardly in the direction of said valve member.

16. A fuel injector as claimed in claim 15 and further comprising:

a recess in said valve seat member having an open end adjacent said tubular outlet member and a base; and wherein said at least one orifice comprises a plurality of orifices through said base.

17. A fuel injector as claimed in claim 16 wherein:

said orifices are directed at an angle with respect to each other and with respect to said outlet passage so that in use a substantially conical fuel spray issues from said exit end of said outlet passage.

18. A fuel injector as claimed in claim 2 and further comprising:

a recess in said valve seat member having an open end adjacent said tubular outlet member and a base; and wherein said at least one orifice comprises a plurality of orifices through said base.

19. A fuel injector as claimed in claim 15 wherein:

at least one flat surface is provided on the outer surface of said tubular outlet member and defines part of said air circulation duct means.

20. A fuel injector as claimed in claim 16 wherein:

at least one flat surface is provided on the outer surface of said tubular outlet member and defines part of said air circulation duct means.

* * * * *